US006483006B1

(12) United States Patent
Sekiguchi et al.

(10) Patent No.: US 6,483,006 B1
(45) Date of Patent: Nov. 19, 2002

(54) METHOD OF DECOMPOSING ORGANOCHLORINE COMPOUND

(75) Inventors: Yoshitoshi Sekiguchi, Osaka (JP); Kunio Sasaki, Osaka (JP); Shingo Tanaka, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 0 days.

(21) Appl. No.: 09/673,195

(22) PCT Filed: Feb. 14, 2000

(86) PCT No.: PCT/JP00/00771

§ 371 (c)(1),
(2), (4) Date: Oct. 12, 2000

(87) PCT Pub. No.: WO00/48968

PCT Pub. Date: Aug. 24, 2000

(30) Foreign Application Priority Data

Feb. 16, 1999 (JP) ..... 11-037561
Feb. 2, 2000 (JP) ..... 2000-024570

(51) Int. Cl.[7] ..... A62D 3/00
(52) U.S. Cl. ..... 588/207; 588/206
(58) Field of Search ..... 588/205, 206, 588/207, 209; 210/758, 763; 423/240 R, 245.1, 245.2

(56) References Cited

U.S. PATENT DOCUMENTS 4,337,368 A 6/1982 Pytlewski ..... 568/730
5,245,111 A * 9/1993 Betz ..... 588/204
5,254,796 A * 10/1993 Dietz et al. ..... 588/206
5,855,760 A * 1/1999 Zen et al. ..... 205/555
6,063,979 A * 5/2000 Miyata et al. ..... 588/205
6,072,099 A * 6/2000 Tanaka et al. ..... 588/205

FOREIGN PATENT DOCUMENTS

| | | |
|---|---|---|
| EP | 0679411 A1 | 11/1995 |
| EP | 0968773 A1 | 1/2000 |
| JP | 55-2412 | 1/1980 |
| JP | 7-144137 | 6/1995 |
| JP | 8-1131 | 1/1996 |
| JP | 8-290053 | 11/1996 |
| JP | 9-249581 | 9/1997 |
| JP | 10-085584 | 4/1998 |
| JP | 10-265413 | 10/1998 |
| JP | 11-197622 | 7/1999 |

* cited by examiner

*Primary Examiner*—Stanley S. Silverman
*Assistant Examiner*—Eileen E. Nave
(74) *Attorney, Agent, or Firm*—Armstrong, Westerman & Hattori, LLP

(57) ABSTRACT

The present invention relates to a method of decomposing organochlorine compounds such as dioxins reductively or catalytically. The organochlorine compounds such as dioxins and o-chloroanisole are decomposed in an aqueous alkali solution in the presence of a reducing agent or a catalyst. The alkali which can be used is at least one selected from the group consisting of sodium hydroxide, potassium hydroxide, sodium carbonate, potassium carbonate and aqueous ammonia. The reducing agent which can be used is at least one selected from the group consisting of sodium hydrosulfite, ascorbic acid, hydrazine, hydrazine hydrate, neutral hydrazine sulfate, hydrazine carbonate, sodium thiosulfate, sodium sulfite, potassium sulfite, hydroquinone, 4-methylaminophenol sulfate and Rongalite. The catalyst which can be used is at least one selected from the group consisting of activated carbon and titanium oxide.

1 Claim, 1 Drawing Sheet

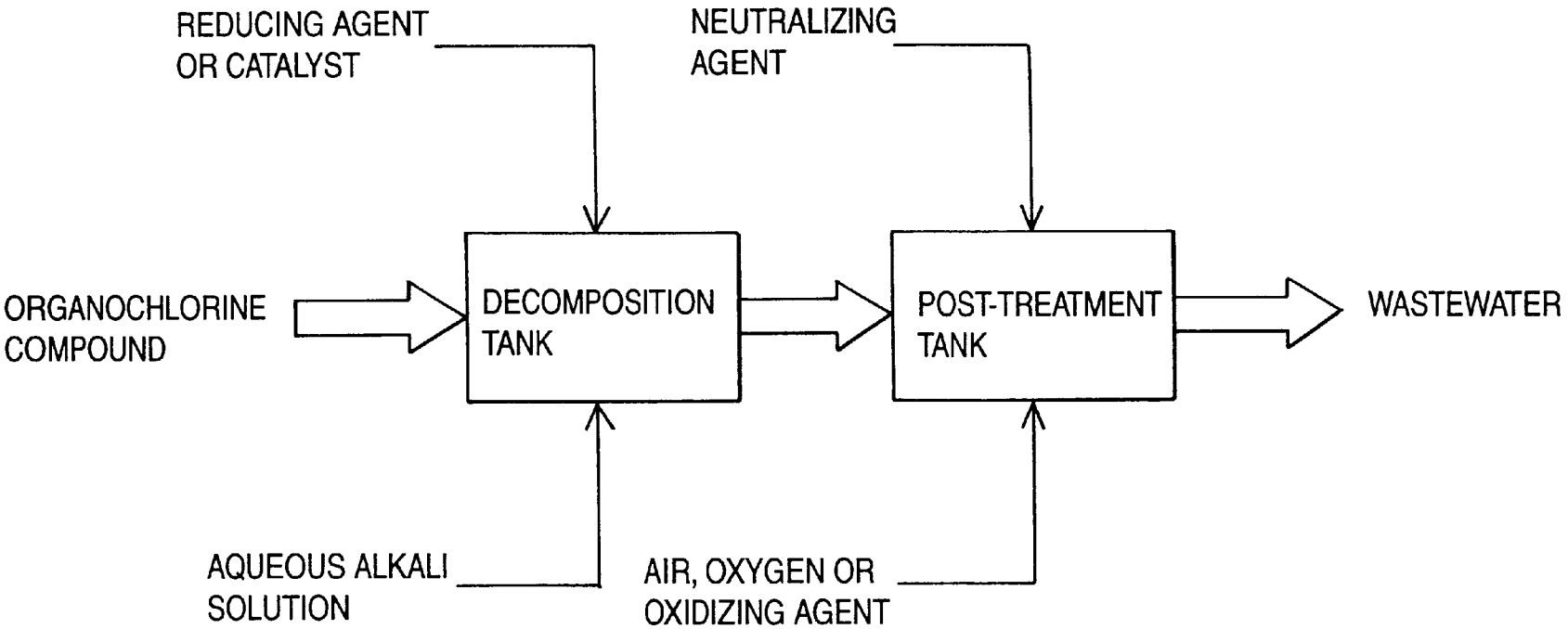
REDUCING AGENT
OR CATALYST
NEUTRALIZING
AGENT
ORGANOCHLORINE
COMPOUND
DECOMPOSITION
TANK
POST-TREATMENT
TANK
AQUEOUS ALKALI
SOLUTION
AIR, OXYGEN OR
OXIDIZING AGENT
WASTEWATER

METHOD OF DECOMPOSING ORGANOCHLORINE COMPOUND

TECHNICAL FIELD

The present invention relates to a method of decomposing organochlorine compounds such as dioxins reductively or catalytically in an autoclave.

BACKGROUND ART

Organochlorine compounds such as dioxins and polychlorinated biphenyls pollute air, river water, groundwater, soil and the like. In Aparticular, organochlorine compounds having toxicity such as carcinogenicity have problems from the viewpoint of environmental pollution. A technique for suppressing discharge of these organochlorine compounds and a technique for decomposing organochlorine compounds existing in the environment in the form of pollutants after discharge have been developed.

In general, organochlorine compounds which cause environmental problems are difficult to decompose naturally. Known methods of making the organochlorine compounds harmless are as follows; a) a method of decomposition with ultraviolet radiation, electron radiation or radial rays, b) a method of decomposition with microorganism, c) a method of decomposition by combustion, d) a method of chemical decomposition with an oxidizing agent, e) a method of oxidative decomposition with supercritical water and the like.

However, the method of decomposition with ultraviolet radiation, electron radiation or radial rays has a disadvantage in that a cost is high or decomposition efficiency is low. In the method of decomposition with the microorganism, decomposition efficiency and a decomposition rate are low. In the method of decomposition by combustion, highly poisonous substances such as dioxins are likely to be generated reversely depending on a combustion condition. In the method of chemical decomposition with the oxidizing agent, the organochlorine compounds can be decomposed in several hours, but corrosion of apparatus materials with the oxidizing agent leads to problems. The method of oxidative decomposition with supercritical water needs too high energy.

An object of the present invention is to provide a method of decomposing the organochlorine compounds such as dioxins which can solve the above-mentioned various problems of the prior arts by decomposing the organochlorine compounds reductively or catalytically.

DISCLOSURE OF THE INVENTION

A method of decomposing organochlorine compounds according to the present invention is a method characterized in that organochlorine compounds such as dioxins and o-chloroanisole are decomposed in an aqueous alkali solution in the presence of a reducing agent and/or a catalyst.

The alkalis which can be used in the present invention are hydroxides and carbonates of alkali metals or alkaline earth metals and the like, and preferably at least one selected from the group consisting of sodium hydroxide, potassium hydroxide, sodium carbonate, potassium carbonate and aqueous ammonia in terms of working environment.

A preferred reducing agent which can be used in the present invention is at least one selected from the group consisting of sodium hydrosulfite, ascorbic acid, hydrazine, hydrazine hydrate, neutral hydrazine sulfate, hydrazine carbonate, sodium thiosulfate, sodium sulfite, potassium sulfite, hydroquinone, 4-methylaminophenol sulfate and Rongalite. They are made harmless during the decomposition treatment.

A preferred catalyst which can be used in the present invention is at least one selected from the group consisting of activated carbon and titanium oxide.

When the organochlorine compound is water-insoluble, it is preferable to add a water-soluble organic solvent to the aqueous solution and thereby dissolving the organochlorine compound in water. Examples of the water-soluble organic solvent can be acetone, methanol and ethanol.

It is preferable to use the reducing agent and/or the catalyst in excess, for example, in an amount (mole) of 1 to 2.5 times the amount of the organochlorine compound.

Decomposition-treatment temperature is preferably 200° to 400° C.

It is preferable to neutralize excess alkali after the decomposition-treatment with a mineral acid such as hydrochloric acid or sulfuric acid.

It is preferable to treat an excess reducing agent after the decomposition-treatment with air, oxygen or an oxidizing agent such as aqueous ozone or aqueous hydrogen peroxide.

It is preferable to use an autoclave as a decomposition tank.

Since the organochlorine compounds such as dioxins are decomposed reductively in the aqueous alkali solution in the method of the present invention, generated chlorine and hydrogen chloride are absorbed by the alkali so that the method does not cause corrosion problems of apparatus materials and the like.

When the reducing agent is used, one has only to oxidize the excess reducing agent and neutralize the excess alkali after the treatment. Accordingly, a treatment cost can be suppressed.

BRIEF DESCRIPTION OF DRAWING

The FIGURE is a flow sheet showing a method of the present invention.

BEST MODE FOR CARRYING OUT THE INVENTION

Next, the present invention is described specifically on the basis of the FIGURE.

An autoclave is used as a decomposition tank, and an organochlorine compound such as dioxins is introduced into the autoclave under an inert atmosphere. Into the autoclave are put a reducing agent and an aqueous alkali solution, or a catalyst and the aqueous alkali solution, and the organochlorine compound is decomposed under elevated pressures and heating.

After the decomposition treatment is finished, excess alkali is neutralized with a neutralizing agent in a post-treatment tank. Preferred neutralizing agents are hydrochloric acid, sulfuric acid and the like. When the catalyst is used, the used catalyst is separated before the post-treatment. The post-treatment tank is aerated with air or oxygen, or an oxidizing agent such as aqueous ozone or aqueous hydrogen peroxide is introduced into the post-treatment tank to treat an excess reducing agent after the decomposition-treatment. Since wastewater after the treatment is harmless, the wastewater does not cause problems even if it is discharged from a system.

The present invention is described more practically by Examples hereinafter, but the scope of the present invention is not limited to the following Examples.

EXAMPLE 1

Into an autoclave was introduced 10 g of o-chloroanisole as an organochlorine compound, and 300 ml of a 1 N aqueous sodium carbonate solution was added thereto under a nitrogen atmosphere. Furthermore, an aqueous hydrazine solution was added thereto in an amount (mole) of 1.5 times the amount of o-chloroanisole, and a reaction was carried out at 300° C. for 30 minutes. After the reaction, hydrazine was decomposed. The reaction mixture was transferred to a post-treatment tank, 1 N sulfuric acid was added to the mixture to neutralize excess alkali, and then the treated liquid was analyzed by gas chromatography. As a result, o-chloroanisole was not detected.

EXAMPLE 2

The same procedure as in Example 1 was repeated except that sodium hydrosulfite was used in an amount (mole) of 1.5 times the amount of o-chloroanisole as the reducing agent. After the reaction, sodium hydrosulfite was decomposed. The reaction mixture was transferred to a post-treatment tank, 1 N sulfuric acid was added to the mixture to neutralize excess alkali, and then the treated liquid was analyzed by gas chromatography. As a result, o-chloroanisole was not detected.

EXAMPLE 3

The same procedure as in Example 1 was repeated except that 300 ml of a 1 N aqueous sodium hydroxide solution was used as the alkali solution. After the reaction, hydrazine was decomposed. The reaction mixture was transferred to a post-treatment tank, 1 N sulfuric acid was added to the mixture to neutralize excess alkali, and then the treated liquid was analyzed by gas chromatography. As a result, o-chloroanisole was not detected.

EXAMPLE 4

The same procedure as in Example 1 was repeated except that 1 g of activated carbon was used as a catalyst instead of the reducing agent. After the reaction, activated carbon was separated from the reaction mixture by filtration. The reaction mixture was transferred to a post-treatment tank, 1 N sulfuric acid was added to the mixture to neutralize excess alkali, and then the treated liquid was analyzed by gas chromatography. As a result, a decomposition rate of o-chloroanisole was 77.5%.

EXAMPLE 5

Into an autoclave was introduced 10 ml of wastewater containing dioxins discharged from an incineration plant. To this wastewater was added 300 ml of a 1 N aqueous sodium carbonate solution under a nitrogen atmosphere. Furthermore, 10 ml of a 98% by weight aqueous hydrazine solution was added thereto, and a reaction was carried out at 300° C. for 30 minutes. The reaction mixture was transferred to a post-treatment tank, 1 N sulfuric acid was added to the mixture to neutralize excess alkali, and then the treated liquid was analyzed by gas chromatography. As a result, a decomposition rate of dioxins was 99.4%.

INDUSTRIAL APPLICABILITY

The present invention relates to a method of decomposing organochlorine compounds such as dioxins reductively or catalytically in an autoclave and is intended to solve problems of environmental pollution.

What is claimed is:

1. A method of decomposing an organochlorine compound, the method comprising decomposing the organochlorine compound in an aqueous solution of an alkali in the presence of a reducing agent and/or a catalyst at a temperature of 200° C. to 400° C., and neutralizing excess alkali with an acid and treating excess reducing agent with air, oxygen or an oxidizing agent, wherein said alkali is at least one selected from the group consisting of sodium hydroxide, potassium hydroxide, sodium carbonate, potassium carbonate and aqueous ammonia, wherein said reducing agent is at least one selected from the group consisting of sodium hydrosulfite, ascorbic acid, hydrazine, hydrazine hydrate, neutral hydrazine sulfate, hydrazine carbonate, sodium thiosulfate, sodium sulfite, potassium sulfite, hydroquinone, 4-methylaminophenol sulfate and Rongalite, wherein said catalyst is at least one selected from the group consisting of activated carbon and titanium oxide, and wherein, when the organochlorine compound is water-insoluble, a water-soluble organic solvent is added to the aqueous solution in such an amount that the organochlorine compound is dissolved in water.

* * * * *